United States Patent [19]

Day

[11] 4,088,282

[45] May 9, 1978

[54] CRUSHABLE BOBBIN PACKAGE FOR CONJUGATE YARN

[75] Inventor: James R. Day, Pensacola, Fla.

[73] Assignee: Monsanto Company, St. Louis, Mo.

[21] Appl. No.: 747,448

[22] Filed: Dec. 3, 1976

[51] Int. Cl.[2] ..... B65H 75/20

[52] U.S. Cl. ..... 242/118.2; 242/159

[58] Field of Search ..... 242/118, 118.1, 118.11, 242/118.2, 118.32, 118.7, 118.8, 159; 428/373, 374

[56] References Cited

U.S. PATENT DOCUMENTS

| | | | |
|---|---|---|---|
| 3,350,030 | 10/1967 | Green | 242/118.32 |
| 3,522,700 | 8/1970 | Fisher | 242/118.2 |
| 3,544,034 | 12/1970 | Jurney | 242/118.32 |
| 3,826,445 | 7/1974 | Hardy | 242/118.32 |

*Primary Examiner*—Edward J. McCarthy
*Attorney, Agent, or Firm*—Kelly O. Corley

[57] ABSTRACT

A drawn conjugate yarn of an elastomer and a non-elastomer is wound on a bobbin with a crushable surface. Yarn can be knit from the resulting package successfully after long storage periods.

6 Claims, 1 Drawing Figure

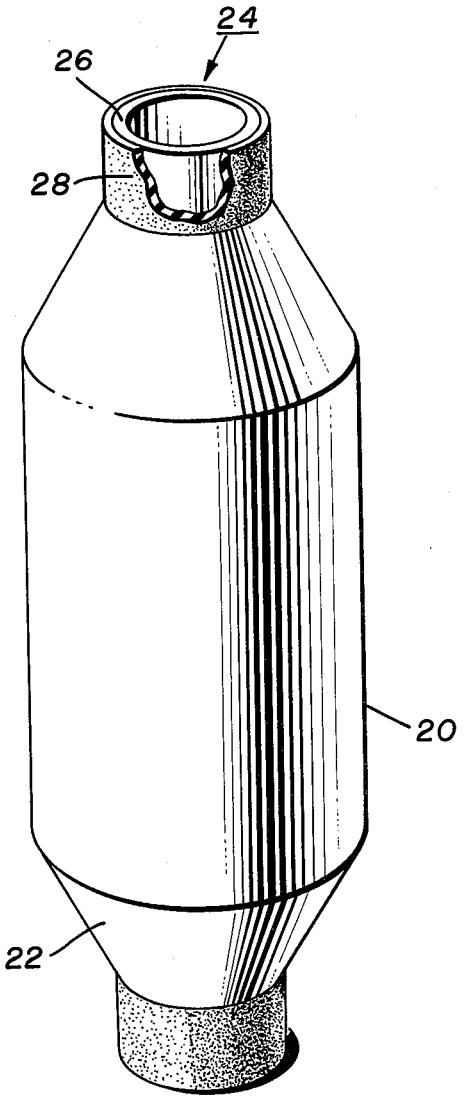
24
26
28
20
22

CRUSHABLE BOBBIN PACKAGE FOR CONJUGATE YARN

The invention relates to the art of packaging conjugate yarn made from a non-elastomeric material and from an elastomeric material. More particularly, it relates to such packaging wherein the yarn can be knit from the resulting package successfully after long storage periods.

Conjugate filaments are known of the type wherein a non-elastomeric material and an elastomeric material are spun in conjugated fashion, as typified by Martin U.S. Pat. No. 3,987,141; Chamberlin U.S. Pat. No. 3,761,348; and Ballman et al. U.S. Pat. No. 3,966,866, the disclosures of which are incorporated herein by reference. When such yarn are drawn and then wound on ordinary rigid bobbins, stresses remain in the yarn which relax or decay with time. Before these stresses relax, large compressive forces develop in the package. The inner layers of yarn are compressed by the outer layers, causing the various inner layers of yarn to become entangled or entrapped with one another. Severe entrapping can occur within hours of the drawing and winding operation, and may continue to increase for as long as two weeks or more. The force necessary to pull the entrapped yarn free exceeds the limits allowable in knitting, and thus the entrapped regions cause knitting interruptions when the original package is used to feed the knitting machine. It has been customary to lag the yarn on the original package for some two weeks, by which time most of the stresses would have relaxed, and then to rewind the yarn into another bobbin or cone suitable for feeding a knitting operation. This rewinding operation is expensive and requires additional manpower and equipment.

It has been discovered that the rewinding step can be eliminated by winding the yarn on a bobbin with a surface layer which yeilds to the compressive forces developed.

According to a first aspect of the invention, there is provided a yarn package comprising a right circularly cylindrical bobbin having a relatively soft surface layer, the surface layer having a Rockwell R hardness value softer than −25, being at least 4mm. thick, and being supported by an inner right circularly cylindrical wall of sufficient strength and thickness to withstand crushing by retraction forces of yarn wound on the bobbin; and yarn wound on the bobbin to form the package, the yarn being a drawn two-component conjugate yarn wherein one component is a non-elastomeric polymer and the other is an elastomeric polymer.

According to another aspect of the invention, the inner wall is formed from kraft paper.

According to another aspect of the invention, the surface layer is formed from chip paper.

According to another aspect of the invention, the surface layer is formed from an elastomer.

According to another aspect of the invention, the yarn is wound on the bobbin at a balloon tension of 2.5 to 4.5 grams.

According to another aspect of the invention, the two components are conjugated in side-by-side configuration.

According to another aspect of the invention, there is provided a process comprising feeding a yarn into a draw zone at a given speed, the yarn being a two-component conjugate wherein one component is a non-elastomeric polymer and the other component is an elastomer, withdrawing the yarn from the draw zone at a speed higher than the given speed whereby the yarn is drawn in the draw zone, and winding the drawn yarn on a bobbin having a relatively soft surface layer, the surface layer having a Rockwell R hardness value softer than −25, being at least 4mm. thick, and being supported by an inner wall of sufficient strength and thickness to withstand crushing by retraction forces of the yarn.

According to another aspect of the invention, the step of winding comprises collecting the yarn on the bobbin with a ring-and-traveller winding mechanism at a balloon tension of 2.5 to 4.5 grams.

EXAMPLE

Spun (undrawn) yarn is cold drawn and wound on a conventional drawtwister equipped with a ring-and-traveller winding mechanism, the balloon tension being controlled at 3 grams by regulating the spindle speed. The spun yarn is the side-by-side conjugated elastomeric polyurethane-nylon 6 monofilament spun yarn disclosed in Example 3 of Ballman U.S. Pat. No. 3,966,866, and the spun denier is 100. The feed roll speed is set at 150 meters per minute and the draw roll speed is set at 600 meters per minute.

One pound of the drawn yarn is collected on each of various bobbins as indicated below.

| Bobbin Type | Remarks |
|---|---|
| A | unsatisfactory, trapped yarn |
| B | unsatisfactory, trapped yarn |
| C | satisfactory |
| D | satisfactory |

Bobbin A is a standard hard bobbin made from kraft paper. Bobbin B has an inner rigid wall made from kraft paper covered with a surface layer 2mm. thick made from chip paper, and having a Rockwell R hardness of −30. Bobbin C is similar to Bobbin B except the surface layer is 5mm. thick. Bobbin D is a rigid steel inner wall covered with a surface layer formed from rubber having a Durometer A hardness of 60, the surface layer being 5mm. thick. Rockwell R hardness is a standard measurement well known to those skilled in the art, and the procedure is specified in the 1976 Annual ASTM Standards, Part 35, Designation D785-65 (reapproved 1970), Procedure A. Likewise, Durometer A hardness is a standard measurement well known to those skilled in the art, and the procedure is specified in the 1976 Annual ASTM Standards, Part 35, Designation D2240-75.

The run on bobbin type C is repeated, except that the balloon tension is adjusted to be 7 grams. Unsatisfactory results are obtained, with considerable trapping of the yarn near the bobbin surface.

The invention is illustrated in the accompanying drawing, wherein yarn 20 is wound with conical end portions 22 on bobbin 24 to provide the desired package. Bobbin 24 comprises inner right circularly cylindrical wall 26 of sufficient strength and thickness to withstand crushing by retraction forces, and a relatively soft outer layer 28, layer 28 having a Rockwell R hardness value softer than −25 and being at least 4 millimeters thick.

I claim:

1. A yarn package, comprising in combination:

a. a right circularly cylindrical bobbin having a relatively soft outer surface layer, said surface layer having a Rockwell R hardness value softer than −25, being at least 4mm. thick, and being supported by an inner right circularly cylindrical wall of sufficient strength and thickness to withstand crushing by retraction forces of yarn wound on said bobbin, and b. yarn wound on said bobbin to form said package, said yarn being a drawn two-component conjugate yarn wherein one component is a non-elastomeric polymer and the other component is an elastomeric polymer.

2. The yarn package defined in claim 1, wherein said inner wall is formed from kraft paper.

3. The yarn package defined in claim 1, wherein said surface layer is formed from chip paper.

4. The yarn package defined in claim 1, wherein said surface layer is formed from an elastomer.

5. The yarn package defined in claim 1, wherein said yarn is wound on said bobbin at a balloon tension of 2.5 to 4.5 grams.

6. The yarn package defined in claim 1, wherein said non-elastomeric polymers and said elastomeric polymer are conjugated in side-by-side configuration.

* * * * *